United States Patent [19]

Colan

[11] 4,297,798

[45] Nov. 3, 1981

[54] FOOTWEAR SYSTEM

[76] Inventor: Laura P. Colan, 400 E. 57th St., New York, N.Y. 10022

[21] Appl. No.: 120,883

[22] Filed: Feb. 12, 1980

[51] Int. Cl.[3] ..... A43B 3/24; A43B 3/12; A43C 13/00

[52] U.S. Cl. ..... 36/101; 36/11.5; 36/15

[58] Field of Search ..... 36/11.5, 100, 101, 12, 36/15, 30 R, 32 R

[56] References Cited

U.S. PATENT DOCUMENTS 2,761,224 9/1956 Gardiner ..... 36/101

3,812,601 5/1974 Flottorp ..... 36/101

3,983,642 10/1976 Liao ..... 36/101

*Primary Examiner*—Patrick D. Lawson

[57] ABSTRACT

There is disclosed an improved system of footwear which permits the wearer to customize the fit and aesthetics of her footwear. A substantially E shaped channel is provided along the length of, and inward of the perimeter of the sole of the assembly. The central arm of the E channel is provided with a series of lacing engagement members in the form of slots. Through selective choice and engagement of the lacings with slots, a myriad of styling and fit adjustments can be made by a wearer.

9 Claims, 9 Drawing Figures

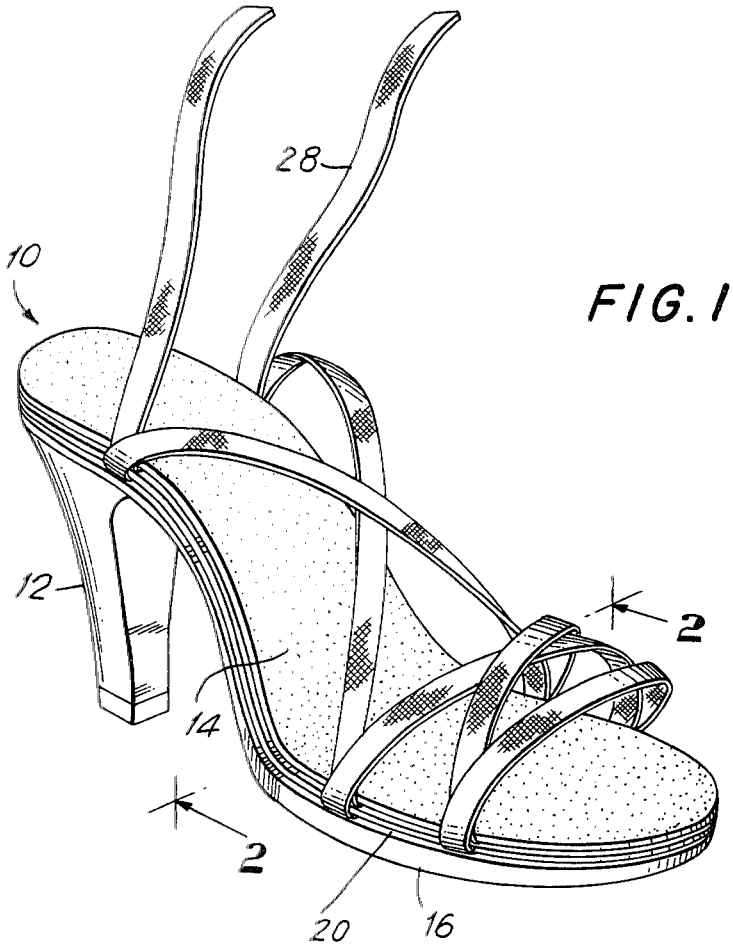
FIG. 1
FIG. 2
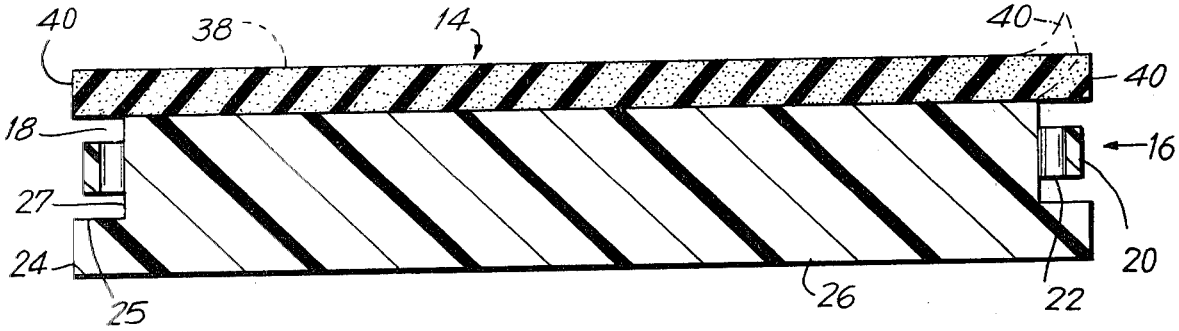
FIG. 4A
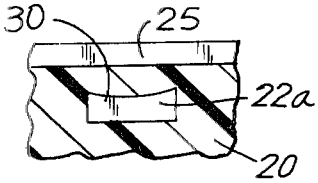
FIG. 4B
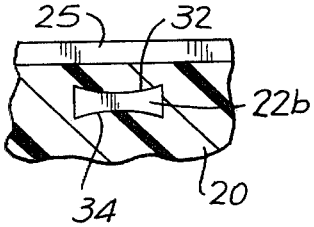
FIG. 4C
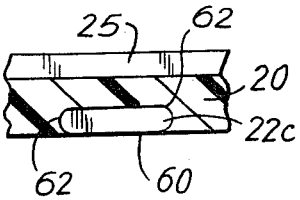

FIG. 3
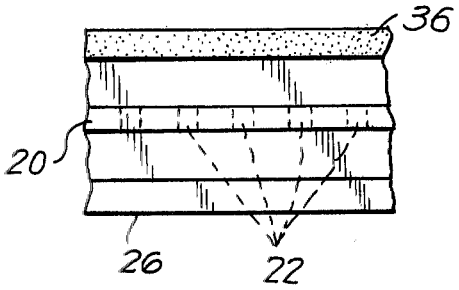
FIG. 5
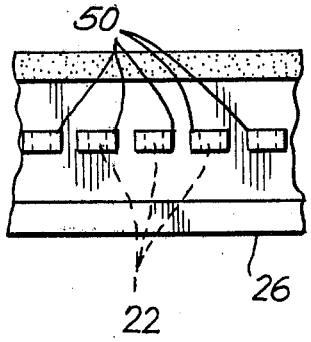
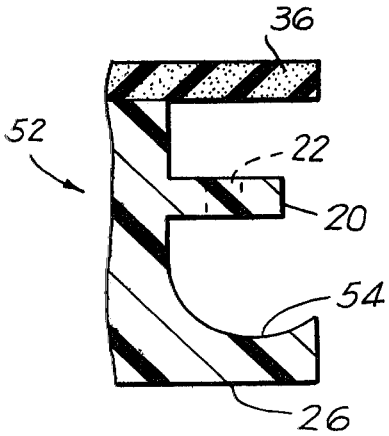
FIG. 6
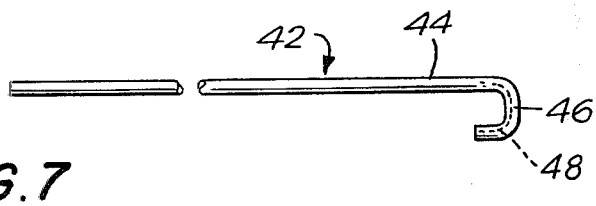
FIG. 7

FOOTWEAR SYSTEM

The present invention relates to footwear and particularly to an improved system which permits the wearer to customize the fit and aesthetics of her footwear.

BACKGROUND OF INVENTION

Fashion requirements dictate that women maintain a varied collection of shoes for wardrobe compatibility. The expense in meeting this need has escalated dramatically with the extreme price rise in the basic raw materials generally employed in shoe manufacture. Expense and fashion aside, women's shoes have long been associated with a relatively high level of discomfort. In part this is a result of mass production. Standardized sizes do not fit many people well. In between sizes and different contours as between a left and right foot forces many purchasers to make compromises as between fit and fashion. Further, even if a relatively comfortably fitting shoe is found, normal fluctuations in body weight and water retention can alter the characteristics of the wearer's feet from day to day so as to render an otherwise comfortable shoe uncomfortable.

There have been many attempts to combine the benefits of fashion, function, economy and comfort. However, it is all too often the case that in meeting one or more of these criteria, compromises have to be made in other attributes. Even if a wearer is fortunate enough to find the right combination it is often short lived, due to the ever-changing fashions.

At least one approach to economy has been the idea of interchangeable parts for shoes. For example, U.S. Pat. No. 2,395,767 to Sutcliffe sought a more economic method of construction for women's shoes by employing inexpensive materials for the soles. In seeking to overcome the difficulties of securing an upper to the sole, Sutcliffe provided pegs or anchors with enlarged heads which project laterally outward of the vertical plane of the sole. A laced upper was secured to the anchors. The entire sole had to be rigid so as not to be distorted by the pull of the upper along the upper peripheral edge of the sole. Aside from the limitations in comfort inherent in the construction, there were many negatives from a fashion point of view. The limited number of studs limited styling; the bulk of the studs, the thickness of the sole and the fact that the studs projected laterally outward of the sole made the shoes unacceptable for all but the most casual of wear.

In U.S. Pat. No. 2,469,708 to Alexander the use of different lacings for fashion versatility was suggested. A plurality of eyelet members were pivotally secured along the side edges of the soles. The eyelets served as anchors for lacings which were passed through selected ones of the eyelets and around the foot of the wearer to create a sandal. Like Sutcliffe, hardware extended beyond the perimeter of the relatively thick sole structure. U.S. Pat. No. 2,976,623 to Galloway was another example of affixation means for foot covering elements, using limited numbers of securement tubes about the perimeter of the sole.

Still others have suggested other manners of attaching lacing arrangements to the sole. See, for example Peterson, U.S. Pat. No. 2,680,309 and Ellis U.S. Pat. No. 2,862,311. In both of these patents transverse slots were made in the sole or sole extensions and lacings threaded therethrough. Ellis' try-on slipper, not being subjected to the abrasion of walking exposed the lacings to the walking surface. Peterson's beach sandal provided a laterally extended portion beyond the normal perimeter of the sole with anchors along this extended portion, thus severely restricting the styling which can be achieved.

However even with the many problems in constructions and an apparent limitation of styling, the desire to employ releasably engaged uppers appears to have been great. See, for example, U.S. Pat. No. 2,761,224 to Gardiner and U.S. Pat. No. 3,204,346 to Lockard et. al. which employed relatively complex arrangements of tracking and T-members; U.S. Pat. No. 2,368,314 to Marx which employed channels and anchors; U.S. Pat. Nos. 2,153,968 and 3,154,866 to Loutbahn which employed either buckles and snaps, fasteners or flanges and strip fasteners to attach the uppers to the soles; U.S. Pat. No. 2,367,092 to Blotner which employed an oversize sole and the securement of lacings outward of the area which the foot occupies; and U.S. Pat. No. 2,509,335 to Dadesman which embedded transverse channels in the sole through which ribbons can be threaded.

Common to these prior attempts were limitations in styling, lace positioning or the ability to create a dress look compatible with business or social wear.

SUMMARY OF INVENTION

The present invention overcomes the deficiencies of the past and with a unique sole construction and various associated parts provides a system which permits the creation by a wearer, in almost limitless variety, of shoes of varying color, fit and aesthetic presentation. According to the present invention a substantially E shaped channel is provided along substantially the entire length of, and inward of the perimeter of the sole. The central arm of the E channel is provided with a series of lacing engagement members, and is preferably formed by a ridge extending longitudinally along the channel equidistant from the top and bottom of the channel. A series of slots extend transversely through the ridge along various portions thereof. By providing this series of slots located inward of the outer perimeter of the sole and along substantially the entire length thereof, an infinite variety of ribbons, laces or other upper materials (generally referred to herein as lacings) can be threaded through and/or secured to the sole and arranged in an infinite variety of patterns.

During wear the slotting arrangement is not readily discernible to the casual observer as the ridge appears as a line along the side wall of the sole, thus enhancing, rather than detracting from the overall aesthetics of the shoe. Since the selection of which slots are to be used in a particular desired arrangement of lacings can be easily varied as can the size of the loops they form, adjustments can be readily made for variations in the wearer's foot size.

The slot locations and their angular disposition and shape, as well as the materials from which the ridge is made is preferably chosen to optimize strength, durability and molding characteristics. It is further preferred that the slotted ridge be integrally molded into at least the base portion of the sole to permit economic production.

It has been found that particularly economic means of mass production can be achieved through the construction of the sole in two sub-assemblies; a base portion is provided which includes the bottom of the sole (with the means for heel affixation therein), the slotted ridge and that portion of the E shaped channel wall that extends vertically upward from the base of the ridge. A top portion is then secured to the base portion. The top portion has substantially the same perimeter contour as the perimeter contour of the base portion so that its outermost portions adjacent the perimeter overlies the ridge in spaced apart relation thereto so as to function as the top of the E shaped channel.

To facilitate the threading of the lacings, the top portion of the sole is preferably a flexible material of relatively high strength with a firm side wall stability. The ability to permit flex will provide a soft cushioning for the foot as well as permit a sufficient degree of "give" along sections adjacent to its perimeter so that access to the slots during lacing is facilitated. The firm side wall will resist undesirable distortion by the lacing material as it extends upward from the slots to its overlying positions relative to the wearer's foot.

In addition, a simple threading implement may also be employed to aid in the lacing. While various implements may be employed, a particular suitable implement includes an elongated shaft having a curvilinear head. The head is slitted so that the lacing material can be releasably engaged and frictionally held in the slit. The curvilinear head has a diameter less than the space between the ridge and the top of the channel as it is defined by the underside of the top portion of the sole as well as the space between the ridge and the bottom of the channel. The head can therefore emplace the leading edge of the lacing material in juxtaposition to either the top or bottom of any slot. By articulating the shaft, the leading edge of the lacing material will pass through the slot and be urged outward of the perimeter of the sole either above or below the ridge, as the case may be. It is highly desirable that the ridge be of a relatively thin cross-section to permit a light looking, relatively thin sole construction. It has been found that the location of the slots and their angular relationship relative to the shape of the sole can lessen the likelihood of failure, such as by breakage of the ridge when the assembled shoe is worn.

Accordingly, in at least one preferred form the present invention provides an improved footwear system comprising a sole assembly and at least one length of lacing material adapted to be affixed to said sole assembly; said sole assembly including a base portion defining the bottom of the shoe, an outer edge perimeter wall about said base portion; a stepped inset portion atop said perimeter wall along substantially the entire length of said perimeter wall defining a ledge substantially parallel to the bottom of said shoe and a vertical wall extending upward at substantially a right angle to said ledge; a ridge section, said ridge section extending outward from said vertical wall along a height substantially intermediate thereof; said ridge extending substantially parallel to said perimeter wall of said base portion and generally inward thereof; a plurality of vertical slots extending through said ridge portion with each said slot adapted to permit said lacing material to pass therethrough; and a top sole covering portion adapted to extend substantially parallel to said bottom portion, the outer edge portion of said top portion adapted to overlie said ridge in spaced apart relationship thereto, whereby said ledge portion and its said vertical wall and said outer edge portion of said top portion define a substantially E shaped channel having a slotted central arm therein to permit the releasable affixation of said lacings thereto.

Additional advantages of the invention will be set forth in the description which follows and, in part will be suggested even further advantages to those skilled in the art.

DRAWINGS

The accompanying drawings illustrate embodiments of the invention and together with the description serve to further explain the principles of the invention.

FIG. 1 is a perspective view of a shoe assembly in accordance with the present invention.

FIG. 2 is a cross-sectional view taken along lines 2—2 of FIG. 1.

FIG. 3 is a side view of a section of the sole assembly of a preferred embodiment of the present invention.

FIGS. 4A, 4B and 4C are top views in enlarged detail showing 3 alternate slot arrangements in accordance with the present invention.

FIG. 5 is a side view of a section of the sole assembly of an alternate embodiment of the present invention.

FIG. 6 is a cross sectional detail of another embodiment of the sole assembly of the present invention.

FIG. 7 is a side elevation of a lacing implement in accordance with the present invention.

Referring now to the drawing where like references numberal denote like parts in the various figures:

DETAILED DESCRIPTION

FIG. 1 illustrates a shoe 10 constructed in accordance with the footwear system of the present invention. As will be appreciated, the heel heights and peripheral shape of the sole are merely exemplary of the myriad of aesthetic presentations which can be achieved. The shoe 10 has been assembled in accordance with the present invention in the nature of a dress sandal having a relatively high heel 12 with a relatively narrow tapered sole assembly 14.

As more particularly shown in FIGS. 2 and 3 the perimeter 16 of the sole assembly 14 defines a substantially E shaped channel 18. In this embodiment, a ridge 20 extends outward to define the central arm of the E channel so as to be substantially equidistant from the top and bottom arms of the E. The ridge 20 does not extend beyond the perimeter of the sole as defined by the outer edge 24 of the bottom of the sole 26. A series of vertical slots 22 extends through the ridge 20. The slots 22 serve as receptacles and anchors for threading through and retaining lacings such as the lacing 28 illustrated in FIG. 1.

While various constructions are possible, it is preferred that the bottom 26 of the sole assembly 14 including the ridge 20 with the slots 22 therein, as well as the vertical portion of the E channel above the ridge 20 be molded as a single unit. The material selected must include characteristics which will enable it to withstand the tensional forces which will be implaced upon the ridge 20 and the bottom 26 during wear. It has been found that a reinforced polyurethane is suitable.

The slots 22 can be of various shapes. It is preferable that the slots not only provide for the ease if implacement of the lacings 28 therethrough but in addition, that they be of a geometric configuration which would lessen the tendency of the ridge 20 to break or weaken during wear. Thus, in addition to the generally rectilinear configuration of slots shown in FIGS. 2 and 3, slots **22*a* such as shown in FIG. 4A may be employed where the side of the slot 30 which faces outward of the sole assembly is concave. In addition to the added strength characteristics which can be achieved through the use of this configuration, the concavity of the side 30, particularly along its juncture with the side walls with walls of the slot 22***a* generally normal to it, provides a greater frictional engagement of the lacings 28 within the slot so as to deter untoward repositioning of the lacings within the slot during wear.

In the embodiment shown in FIG. 4B not only is the side 32 which faces outward of the sole assembly concave, the side 34 opposite thereof is convex. This further narrows the slot to deter undesirable movement of the lacings, yet provides sufficient width to facilitate threading.

In FIG. 4C the slot 22*c* begins along the ridge 20 at its point of juxtaposition to the vertical wall 27, so that the rear wall 60 of the slot 22*c* is part of the vertical wall 27.

In addition, the sides 62 of the slot 22*c* are rounded for strength and to aid in the insertion of the lacings.

The integrally molded base section therefore includes the bottom 26, an outer edge perimeter wall 24 which defines the perimeter shape of the sole of the shoe; a step inset portion beginning along the top edge of the perimeter wall 24 forming a substantially ledge 25, a vertical wall 27 extending upward at substantially a right angle to the ledge 25; and a ridge 20 along the vertical wall 27 extending substantially normal to the vertical slots 22 (or a variation thereof) in serial alignment extending through the ridge 20.

A top sole covering portion 36 is secured to the top of the molded bottom section with the outer edge of the top sole covering portion 36 overlying in spaced apart parallel relationship, the ridge 20 to the bottom 26.

The sole assembly thus forms a substantially E shaped channel. The clearance both above and below the ridge 20 permits the lacing material 28 to be threaded through the slots 22.

While various materials are suitable for use as the top sole covering portion 36, preferably the top sole covering portion 36 is a resilient microcellular polyether urethane foam material. Such a material has excellent molding characteristics; good flex performance for cushioning the foot of the wearer, yet provides good side wall stability so that the pressure of the lacings 28 along the side edge 40 of the top sole covering portion 36 does not damage the material nor cause an undesirable repositioning of the lacings inwards towards the foot of the wearer.

It is preferable that the top sole covering portion 36 be flexible because this will provide additional comfort to the wearer, and as shown in phantom in FIG. 2, the outer edge portion 40 which overlies the ridge 20 can be caused to deflect upward to provide better access to the slots 22 for threading of the lacings 28.

While the ridge 20 has been shown as an unbroken extent, FIG. 5 illustrates an alternate form of construction wherein the ridge is a discontinuance arrangement of flange-like sections 50 with each section having a slot 22 therethrough.

FIG. 6 illustrates another embodiment of the present invention. As illustrated therein the sole assembly 52 includes a dish-like ledge portion 54 which provides an additional space for manipulation of the lacing 28 and serves to guide the lacing outward of the channel as it rides along the curvilinear surface of the ledge 54 and escapes the channel.

While the bottom 26 has been shown as the bottom of the shoe 10, it is to be understood that supplemental soling materials (not shown) may be affixed beneath the bottom 26 in a manner which will be obvious to those skilled in the art.

Similarly, the heel 12 may be affixed to the bottom 26 through known means and the bottom 26 may include therein mounting and or assembly means.

While threading may be accomplished by facile manipulation of the lacing by the wearer without the aids of any tools, FIG. 7 illustrates a simple threading implement 42 which may be employed to aid in the lacing. The threading implement 42 includes a elongated shaft 44 with a curvilinear head 46 which includes a slitting 48 in the head 46. The lacing material 28 can be releasably engaged and frictionally held by the slitting 48. The curvilinear head 46 has a diameter less than the distance between the ridge 20 (or flange-like members 50) and the underside of the top sole covering portion 36, or the ledge 25 or ledge 54. The curvilinear head 46 can therefore implace the leading edge of the lacing material 28 in juxtaposition to the slot 22. By articulating the shaft 44 the leading edge of the lacing material 28 can pass through the slot 22 and be urged outward of the perimeter of the sole.

It will be noted, as illustrated in FIG. 1, that it is preferable that the ridge 20 follow on a parallel course to the curvilinear form of the upper sole covering 36. Thus, where the sole is curved to follow the natural contour (or desired aesthetic presentation) of the foot, the ridge 20 is also oriented so as to follow that contour. It has been found that by also having the key-way of the associated slots 22 follow the same contour a lesser strain is emplaced upon the ridge by the lacings during wear.

It should be readily apparent that a wearer has innumerable options in terms of styling, fit and adjustment by varying the color and nature of the material employed for the lacings; the implacement of the lacings through various of the slots; and the amount of tension placed on the lacings.

It should also be apparent that the details relative to materials and construction may find adequate substitution in other technically equivalent material. The drawings and specifications have set forth preferred embodiments of the invention, and although specific terms are employed, they are used in a generic and descriptive sense only, and not for purposes of limitation. The scope of the invention is defined in the appended claims.

What is claimed is:

1. An improved footwear system comprising a sole assembly including a base portion defining the shape of the sole and having an outer edge perimeter wall; a stepped inset portion atop said perimeter wall along substantially the entire length of said perimeter wall defining a ledge, a vertical wall extending upward at substantially a right angle to said ledge; a ridge section, said ridge section extending outward from said vertical wall along a height substantially intermediate thereof; said ridge extending substantially parallel to said perimeter wall of said base portion and laterally inward thereof; a plurality of vertical slots extending through said ridge portion with each said slot adapted to permit said lacing material to pass therethrough; and a top portion adapted to extend substantially parallel to said bottom portion, the outer edge portion of said top portion adapted to overlie said ridge in spaced apart relationship thereto; whereby said ledge portion and its said vertical wall and said outer edge portion of said top portion define a substantially E shaped channel having a slotted central arm therein to permit the releasable affixation of shoe upper material thereto.

2. An improved footwear system according to claim 1 wherein said shoe upper material is at least one length of lacing.

3. An improved footwear system as claimed in claim 1 wherein said top sole covering portion is flexible, at least along its outer edge.

4. An improved footwear system as claimed in claim 1 wherein each of said slots is substantially rectilinear.

5. An improved footwear system as claimed in claim 1 wherein at least one side of said slot is concave.

6. An improved footwear system as claimed in claim 4 wherein said side faces outward of said shoe and the side opposite said concave side is convex.

7. An improved footwear system as claimed in claim 1 wherein said ridge is a discontinuant extent of flange-like members.

8. An improved footwear system as claimed in claim 1 wherein said ledge portion includes a dish-like surface.

9. An improved footwear system as claimed in claim 1 wherein said shoe upper material is at least one length of lacing and further including a threading implement, said threading implement having a elongated shaft and a curvilinear head with said head slitted so as to permit the releasable engagement of a lacing material therein, said curvilinear head having a diameter less than the heights between the top of each said slot and the underside of the upper sole covering portion.

* * * * *